United States Patent [19]

Cornell et al.

[11] 4,198,087

[45] Apr. 15, 1980

[54] CATCHING DEVICE FOR COVER OF GARBAGE OR REFUSE CAN

[76] Inventors: John R. Cornell; George Spector, both of 3615 Woolworth Bldg., 233 Broadway, New York, N.Y. 10007

[21] Appl. No.: 665,238

[22] Filed: Mar. 9, 1976

[51] Int. Cl.[2] ..... E05C 19/06

[52] U.S. Cl. ..... 292/246; 292/256.5

[58] Field of Search ..... 292/205, 218, 246, 247, 292/256.5, DIG. 49

[56] References Cited

U.S. PATENT DOCUMENTS

| | | | |
|---|---|---|---|
| 1,000,373 | 8/1911 | Burnett | 292/205 X |
| 1,033,785 | 7/1912 | Cowell | 292/205 |
| 1,584,585 | 5/1926 | Woods | 292/247 |
| 1,966,772 | 7/1934 | Thaheld | 292/246 X |
| 2,459,666 | 1/1949 | Harris | 292/246 |

*Primary Examiner*—Richard E. Moore

[57] ABSTRACT

A latching device for securing a cover upon a garbage or refuse can so to prevent the refuse from being scattered for stray animals or by viscious persons; the device consisting of the cover being hinged to the can, and a latch being provided which includes a long bar secured at one end to the cover and the other end having a pivotable formed wire that swings to hook around a refuse can handle and which thereafter is in a position to receive a staple of a padlock so to prevent pivoting it back again and off the handle.

2 Claims, 5 Drawing Figures

15
11
10
13
14
12
31
32
16
PADLOCK
33

14

35
16
23
32
33

14
20
12
30
28
16
17
29
14
16

14
19
34
21
23
22
21
26
23
24
27
24
25
27
25
17
20
26
19
27
21
24
22
25
27
18
23
21
24
23

CATCHING DEVICE FOR COVER OF GARBAGE OR REFUSE CAN

This invention relates generally to refuse can latches and locks.

A principal object of the present invention is to provide a latch and lock that can be quickly and readily applied to a refuse can so to prevent the refuse can cover to be removed therefrom and thus preventing garbage from being scattered about an out-of-doors which would made a resident to be subject to a fine by a sanitation inspector.

Another object is to provide a latch and lock which will prevent stray animals such as dogs foraging for food, from removal of the cover so to gain access to the can content.

Yet another object is to provide a latch and lock which will present vandals, vicious or mischievous persons from scattering refuse so to litter a property.

Other objects are to provide a latch and lock which is simple in design, inexpensive to manufacture, rugged in construction, easy to use and efficient in operation.

These and other objects will be readily evident upon a study of the following specification and the accompanying drawing wherein.

Figures 1, 2, 3, 4, 5:
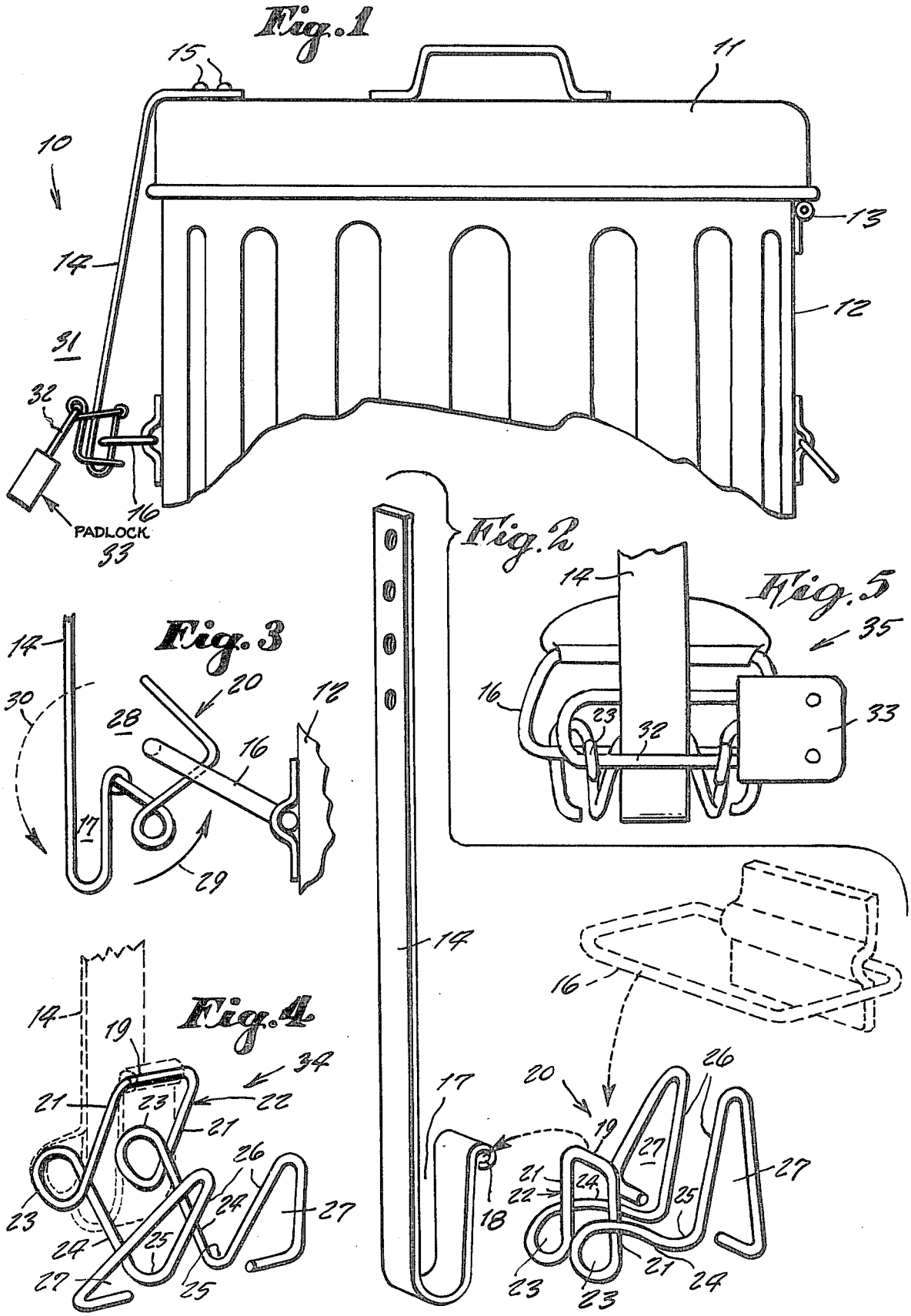
FIG. 1 is a side view of the invention mounted on a garbage can.
FIG. 2 is an exploded perspective view of the components thereof.
FIG. 3 is a side view showing the locking procedure of the invention.
FIG. 4 is a perspective view of a modified design of the invention in which the wire member is bent in a shape so that it cannot be unbent by an unauthorized person once it is secured by a padlock.
FIG. 5 is a view of a modified design of the invention.

Referring now to the drawing in greater detail, and more particularly to FIGS. 1 to 3 thereof at this time, the reference numeral 10 represents a latch-n-lock according to the present invention wherein the same is applied to a cover 11 for securement against opening upon a garbage or refuse can 12.

The cover is pivotally secured at one end to the can by means of a hinge 13. Upon the opposite end of the cover, one end of a long, metal bar 14 is permanently secured by rivets 15, the other end of the bar being downwardly bent so to extend in front of a handle 16 of the can. This lower end of the bar is bent into a U-shaped loop 17 and a terminal end thereof is rolled to form an opening 18 in which a center portion 19 of a configurated, formed wire member 20 is pivotally retained. Each opposite end of the wire is similarly bent and includes a leg 21 adjacent the center portion; the legs 21 with the center portion forming a U-shaped section 22 adjacent each end of which there is a loop 23 from each of which there extends a straight leg 24 having a right angle bend 25 at its end and a straight leg 26 adjacent the bend, the legs 24 and 26 thus being at right angle to each other, and the terminal other end of leg 25 being bent into a triangular loop 27. The loops 23 are parallel and spaced to each other along a common central axis. The legs 24 are parallel and spaced from each other. Likewise, the legs 26 are parallel and spaced to each other. The triangular loops 27 are bent over at right angle so to be on a same flat plane. Each legs 21 is parallel to legs 26 so that together with legs 24 they form a large U-shaped mouth 28, as shown in FIG. 3, into which the can handle 16 is hooked as the wire is pivoted, as shown by the dotted arrow 30 of FIG. 3, the loops 23 are brought into the position shown in FIG. 1 so that the axis thereof is on a front side 31 of the bar. Thus when a staple 32 of a padlock 33 is then fitted through the loops, the wire cannot be pivoted backward again so that the handle 16 cannot be removed from the mouth 28. As is clearly shown in FIG. 1, when the wire is thus fully pivoted to the position shown, the mouth 28 thus unites with U-shaped loop 17 of the bar so that the handle is thus locked therein.

Thus the cover is secured so it cannot be pivoted into an opened up position.

In FIG. 4, a wire member 34 is shown that is exactly the same as wire member 20 except that in this design, the legs 21 extend around the outer sides of the legs 24, so that the two legs 24 are retained between the two legs 21. This design makes it impossible for an unauthorized person to unbend the wire in order to open up the loops 23 and free the padlock staple from the device.

Both designs of the wire member 20 and 34 are hardened so to resist being unbent. In each design, the triangular loop 27 serves as a thumb and finger rest for turning the latch.

In FIG. 5, another modified design 35 of the invention is shown wherein two wire turns are on the inside, instead of on the outside. This gives the padlock more room for locking, and it also makes the latch more foolproof.

Thus different designs of the invention are provided.

While various changes may be made in the detail construction, it is understood that such changes will be within the spirit and scope of the present invention as is defined by the appended claims.

What is claimed is:

1. In a latch-n-lock, the combination of a refuse can, a cover pivotally connected by a hinge upon said can, and a latch device for securing said can in a closed position, said latch comprising a long metal bar riveted at one end upon said cover, an opposite end of said bar being downwardly bent and positioned in front of a handle on a side of said can, a lower end of said bar having a U-shaped loop, a terminal edge of said lower end pivotally supporting a wire member about a U-shaped central section thereof, opposite ends of said wire member being each similarly bent and configurated and including a loop adjacent said U-shaped center section, said loops being axially aligned and spaced apart, a U-shaped mouth adjacent each loop and a thumb and finger rest adjacent each said mouth.

2. The combination as set forth in claim 1 wherein each said mouth hooks on said can handle and aligns with said bar lower end U-shaped loop when said wire member is pivoted so that said axis of said loops is brought on a front side of said bar and said loops receive a staple of a padlock.

* * * * *